US007192064B2

(12) United States Patent
Hsu

(10) Patent No.: US 7,192,064 B2
(45) Date of Patent: Mar. 20, 2007

(54) EXTRUSION-SEALED STRUCTURE OF HEAT PIPE

(76) Inventor: Hul-Chun Hsu, 6F.-3, No.422, Sec. 2, Liming Rd., Taichung City 408 (TW)

( * ) Notice: Subject to any disclaimer, the term of this patent is extended or adjusted under 35 U.S.C. 154(b) by 141 days.

(21) Appl. No.: 11/075,694

(22) Filed: Mar. 10, 2005

(65) Prior Publication Data

US 2006/0202474 A1 Sep. 14, 2006

(51) Int. Cl.
*F16L 13/14* (2006.01)

(52) U.S. Cl. ..... 285/382; 165/104.26

(58) Field of Classification Search ..... 285/382, 285/286.2, 288.1; 165/104.26
See application file for complete search history.

(56) References Cited

U.S. PATENT DOCUMENTS 3,680,189 A * 8/1972 Noren ..... 165/104.26
6,463,911 B1 * 10/2002 Treusch et al. ..... 123/467
6,568,370 B1 * 5/2003 Treusch et al. ..... 123/467
6,830,098 B1 * 12/2004 Todd et al. ..... 165/104.33
6,871,635 B2 * 3/2005 Curran et al. ..... 123/456
6,957,691 B2 * 10/2005 Hsieh ..... 165/104.26
7,073,257 B1 * 7/2006 Hsu ..... 165/104.26

* cited by examiner

*Primary Examiner*—David Bochna

(57) ABSTRACT

An extrusion sealed structure of a heat pipe. A heat pipe that has been extrusion-sealed includes a circular tubular body with two free ends connected to conical shrunk tubular portions. One end of each shrunk tubular portions is connected to the circular tubular body, and the other end of the shrunk tubular portion has one side surface extruded into a recessed portion and the other side surface retains the shape of the circuit tubular body and the shrunk tubular portion. The sealing portion is located at a central axis of the tubular body.

1 Claim, 7 Drawing Sheets

EXTRUSION-SEALED STRUCTURE OF HEAT PIPE

BACKGROUND OF THE INVENTION

The present invention relates in general to a extrusion-sealed structure of a heat pipe, and more particularly, to a device using extrusion-sealing process to form a sealing portion of a heat pipe, so as to reduce the processing time and procedure and enhance production speed of heat pipes.

Having the fast thermal conduction efficiency, the heat pipes have been broadly applied as heat dissipation devices to quickly dissipate heat generated by electronic products.

The conventional fabrication process of heat pipes starts with the tubular body cutting process and shrinking process at two ends of the tubular body. After the shrinking process, one of the shrunk ends is soldered, and working fluid is introduced into the tubular body from the other shrunk end. After the working fluid is filled in the tubular body, gas removal process is performed, followed by the process of sealing and soldering the shrunk end.

After the shrinking process, a gradually shrunk section 11 and an extrusion section 1B (as shown in FIGS. 1 and 2) that has a diameter smaller than that of the gradually shrunk section 11 is formed. The sealing end 1C and soldering are actually performed on the extrusion section 1B to complete the heat pipe fabrication. The shape of the extrusion section 1B serves to control the exterior dimension smaller than the diameter of the tubular body, so as to provide advantages in subsequent puncturing heat dissipation fins.

However, as the gradually shrunk section 1A and the extrusion section 1B are formed using gripper of a shrinking machine. The heat pipe is rotating during the gripping process. This method for shrinking tube consumes a long time and requires tedious process procedures; and therefore, reduces the production speed. Further, the pressed section 1B easily cause congestion of the wick structure, particularly the metal mesh wick structure.

SUMMARY OF THE INVENTION

A novel extrusion-sealed structure is provided allowing reduction in processing time and procedure, such that the production can be speeded up, and the production can be increased.

The extrusion-sealed structure is formed by utilizing the circuit elongate tubular body after the extrusion sealing process. The circuit tubular body has two free ends connected to conical shrunk tubular portions. One side surface of each conical shrunk tubular portions is pressed into a recessed portion (or in a slanted stilliform), while the other side surface of the conical shrunk tubular portion retains the shape of the tubular body and shrunk tubular portions (or arc shape). The sealing portion is located at the central axis (or perimeter) of the tubular body.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1:
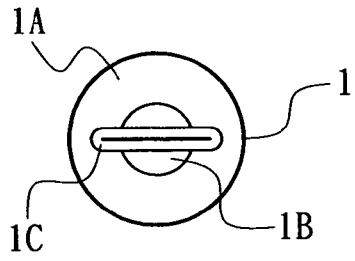
FIG. 1 PRIOR ART
FIG. 1 is a schematic drawing showing the exterior feature of the shrunk sealing portion of a conventional heat pipe.
Figure 2:
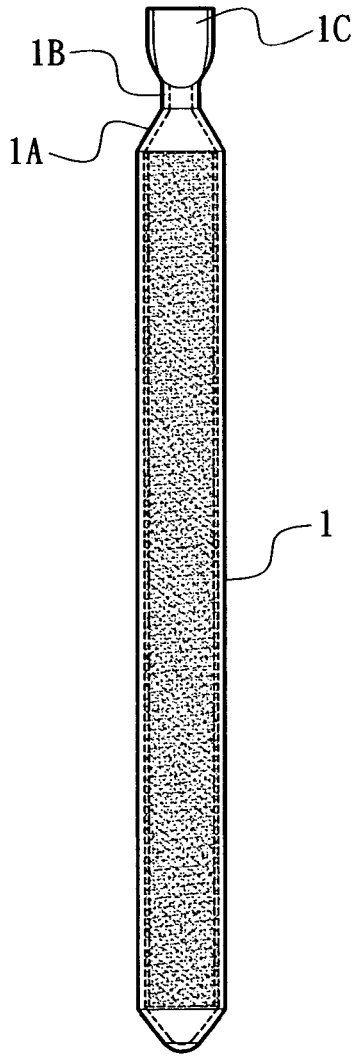
FIG. 2 PRIOR ART
FIG. 2 shows the exterior feature of another conventional heat pipe.
Figure 3:
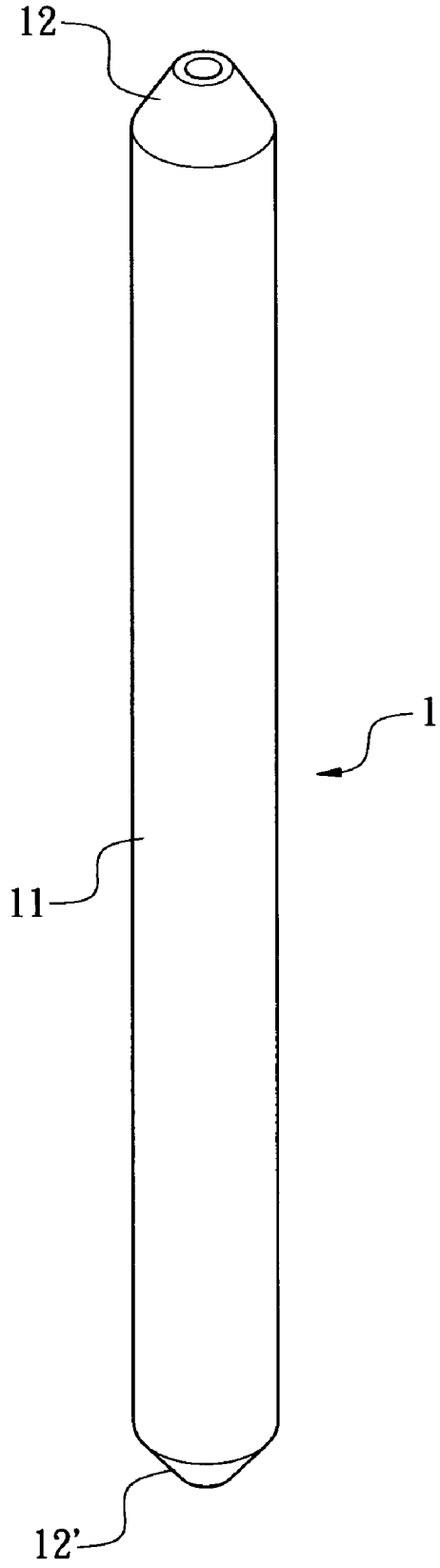
FIG. 3 shows the exterior feature of a shrunk sealing portion of a heat pipe.
Figure 4:
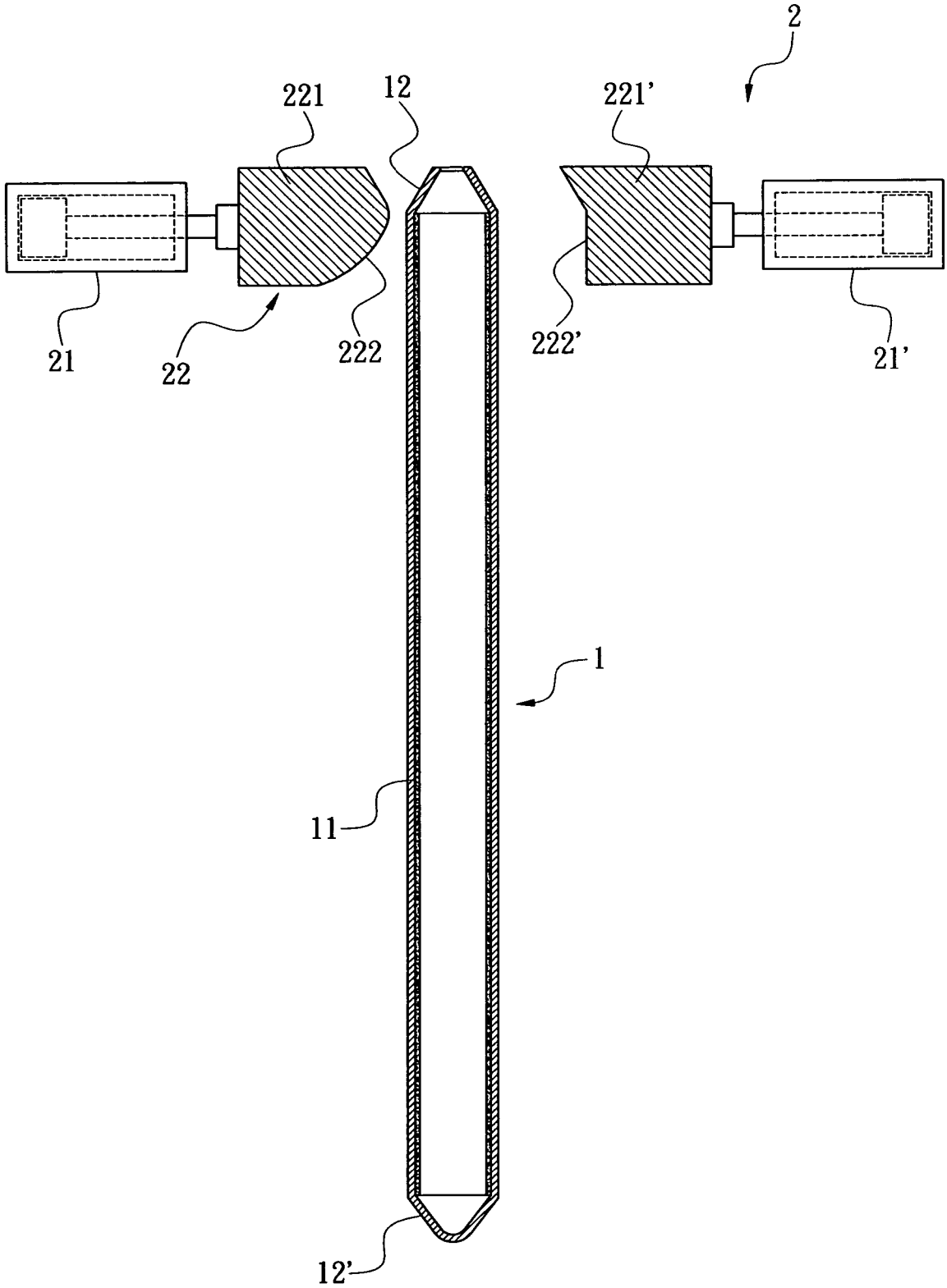
FIGS. 4 and 5 show the operation of extrusion sealing process of a heat pipe.
Figure 5:
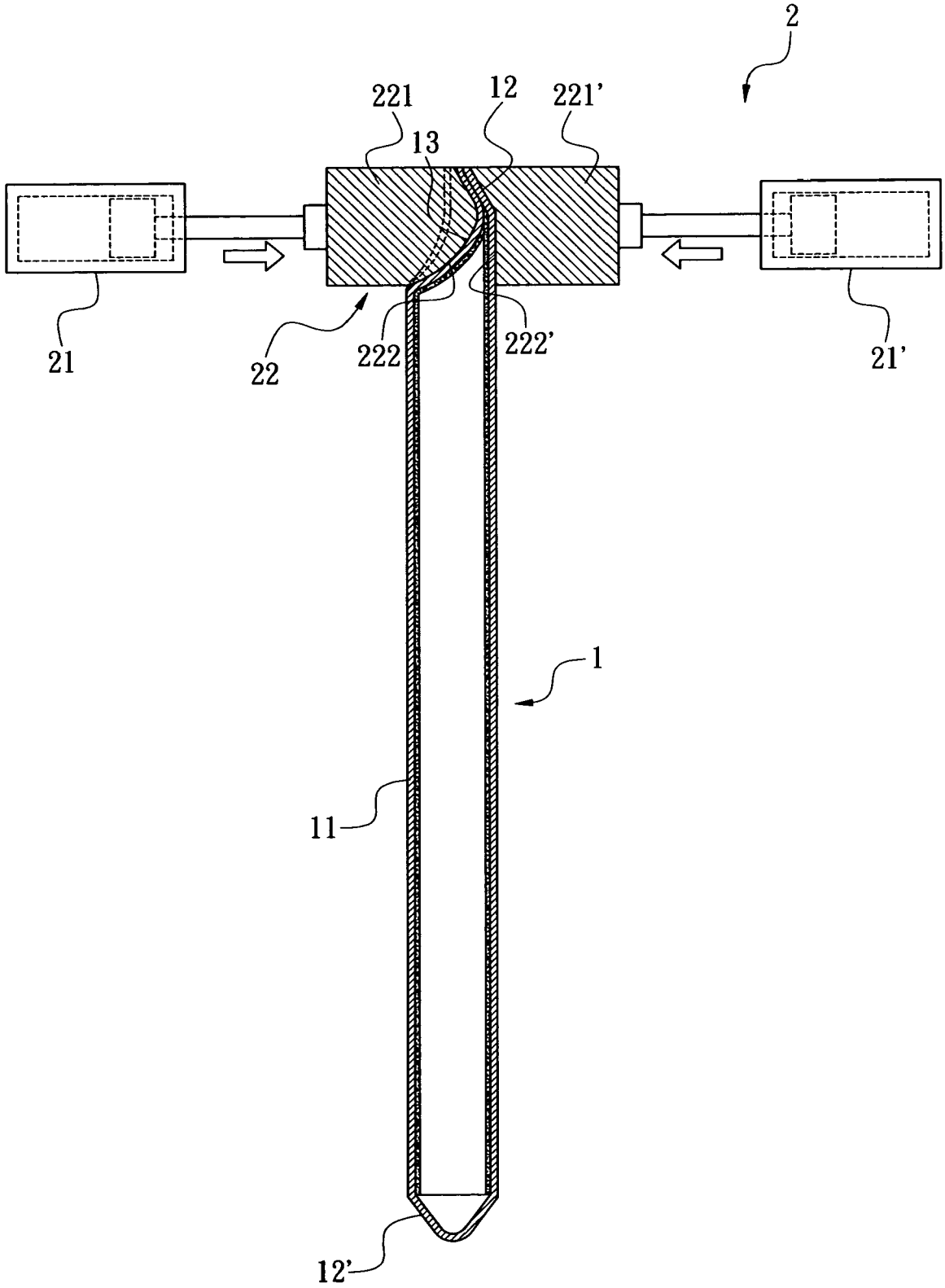

Referring to FIGS. 3–5, the exterior features and the extrusion sealing operation of a heat pipe that has been subjected to shrinking process are illustrated with reduced fabrication time and procedures.

After cutting a heat pipe 1, a tube shrinking device (not shown) is used to perform shrinking process at two ends of the heat pipe 1. Thereby, two conical shrunk tubular portions 12 and 12' are formed at the ends of the heat pipe 1. The shrunk tubular portion 12' is soldered, while a working fluid is filled into the heat pipe from the shrunk tubular portion 12 at the other end of the heat pipe 1.

When the working fluid (not shown) is filled into the heat pipe 1 through the shrunk tubular portion 12, the heat pipe 1 is heated to perform gas removal process.

After the gas removal process, the heat pipe 1 is disposed into the extrusion device 2 to perform extrusion sealing process (as shown in FIGS. 4 and 5). Meanwhile, the power generating devices 21 and 21' of the extrusion device 2 are controlled externally to push the mold 22 to perform extrusion sealing operation, such that the sealing portion 14 is formed at the central axis of the heat pipe 1.

Referring to FIGS. 4 and 5, the device forming the sealing portion of the heat pipe includes an extrusion device 2 that includes power generating devices 21, 21' and a mold 22.

The power generating devices 21 and 21' include oil press tank, gas press tank, or motor with an external control to output force for pushing the mold to perform extrusion operation.

Figure 6:
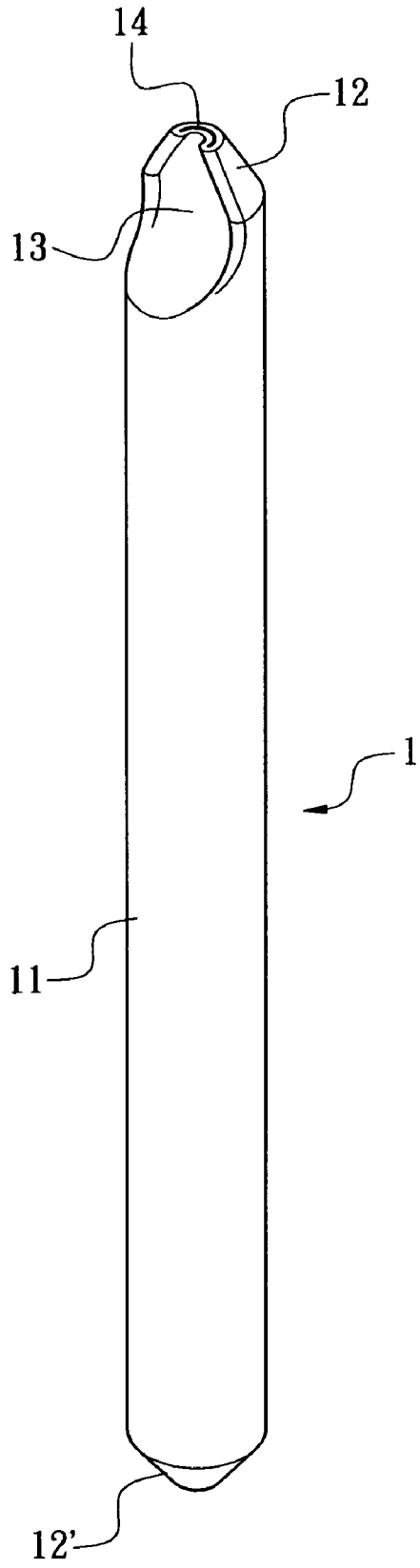
FIG. 6 shows the exterior feature of the heat pipe after the extrusion sealing operation.

The mold 22 includes a first extrusion mold 221 and a second extrusion mold 221'. The first extrusion mold 221 has a convex extrusion surface 222 and the second extrusion mold 221' has a concave extrusion surface conformal to the joint between the tubular body 11 and the shrunk tubular portion 12 of the heat pipe 1. Therefore, after being pressed by the first and second extrusion molds 221 and 221', one side surface of the tubular body 11 and the shrunk tubular portion 12 of the heat pipe 1 have a recessed configuration 13, while the other side surface retains the original tubular body 11 and the shrunk tubular portion 12 (as shown in FIG. 6). The extrusion sealing portion 14 is located at the central axis of the heat pipe 1.

Figure 7:
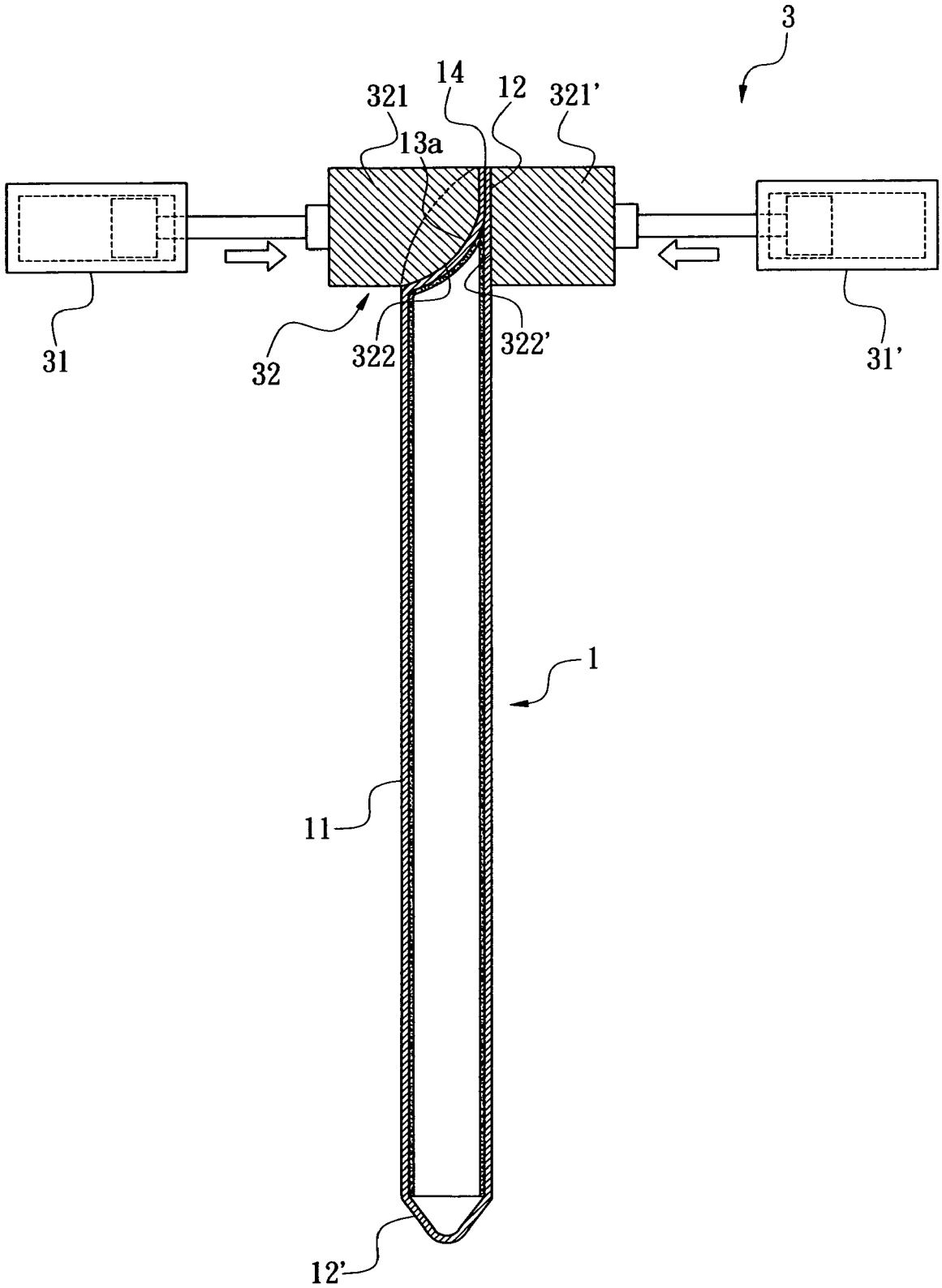
FIG. 7 shows another operation of extrusion sealing process of a heat pipe.
Figure 8:
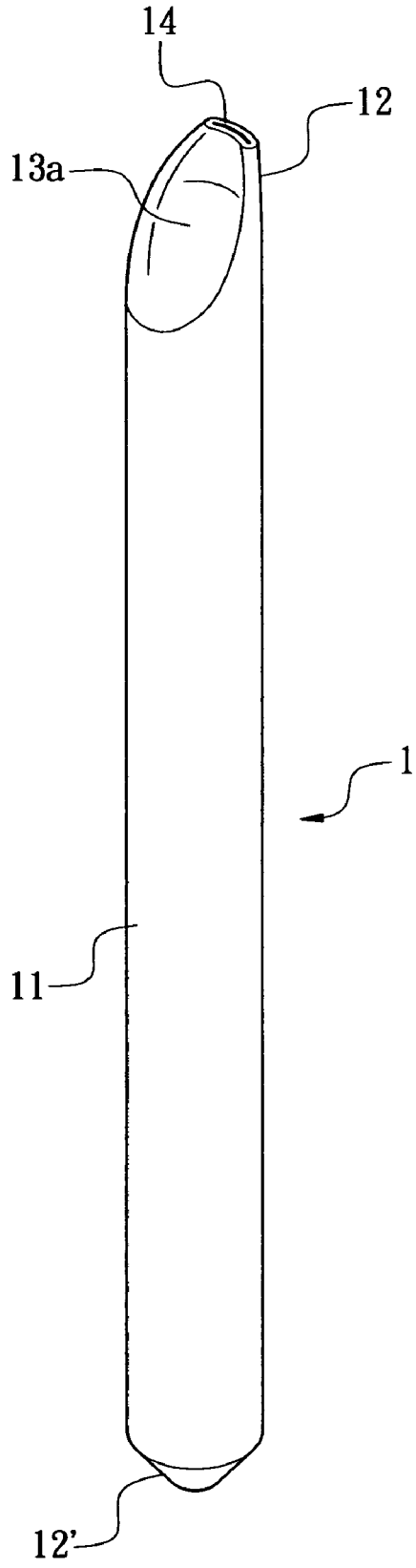
FIG. 8 shows the exterior feature of the heat pipe after the extrusion sealing process as shown in FIG. 7.

Referring to FIGS. 7 and 8, another heat pipe extrusion process and the exterior feature of the heat pipe after extrusion process are illustrated. In this embodiment, after gas removal process, another extrusion device 3 is used to perform extrusion on the conical shrunk portion 12 of the heat pipe 1. The extrusion device 3 also comprises externally controlled power generating devices 31, 31' to push the mold 32 for extrusion operation.

The power generating devices 31 and 31' include oil press tank, gas press tank or motor for pushing the mold 32.

The mold 32 includes a first extrusion mold 321 having an extrusion surface 322 in the form of a slanted surface or stilliform, while the second side surface has a concave curved shape. Therefore, after performing the extrusion process by the extrusion molds 321 and 321', the shrunk tubular member 21 is pressed into an inclined stilliform 13*a*, while the other portion between the tubular member 11 and the shrunk portion 12 has an arc shape. Thereby, the sealing portion 14 at the top end of the heat pipe 1 is located at the perimeter of the heat pipe 1.

After the gas removal process, by the extrusion process performed by the extrusion devices 2 and 3, the heat pipe 1 can be produced with reduced time and procedure.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An extrusion sealed structure of a heat pipe, including a tubular body having two free ends connected to respective conical shrunk tubular portions, wherein a joint between the tubular body and conical shrunk tubular portions has one side surface pressed into a recessed portion and the other side surface retaining original shape of the tubular body and the conical shrunk tubular portion, such that a sealing portion is formed at a partial circumference of a circle radially outward of a central axis of the tubular body.

* * * * *